US007476021B2

(12) United States Patent
Stock et al.

(10) Patent No.: US 7,476,021 B2
(45) Date of Patent: Jan. 13, 2009

(54) ROOFING MEMBRANE TEMPERATURE INDICATOR

(75) Inventors: Thomas J. Stock, Westminster, CO (US); Raymond C. Swann, Kansas City, MI (US); Christopher James Griffin, Aurora, CO (US); Joel Evan Hazy, Brighton, CO (US)

(73) Assignee: Johns Manville, Denver, CO (US)

( * ) Notice: Subject to any disclaimer, the term of this patent is extended or adjusted under 35 U.S.C. 154(b) by 643 days.

(21) Appl. No.: 11/127,429

(22) Filed: May 12, 2005

(65) Prior Publication Data

US 2006/0272228 A1 Dec. 7, 2006

(51) Int. Cl.
*G01K 1/06* (2006.01)
*G01K 11/20* (2006.01)
*E04D 11/02* (2006.01)

(52) U.S. Cl. ..... 374/141; 374/161; 52/408; 116/216

(58) Field of Classification Search ..... 374/161, 374/162, 102–106, 141, 43, 44, 57; 116/216
See application file for complete search history.

(56) References Cited

U.S. PATENT DOCUMENTS

| | | | | |
|---|---|---|---|---|
| 4,066,599 | A | 1/1978 | Zimmerman | |
| 4,195,009 | A | 3/1980 | Zimmerman | |
| 4,390,570 | A | 6/1983 | Rehberg | |
| 4,442,148 | A | 4/1984 | Stierli | |
| 4,745,032 | A | 5/1988 | Morrison | |
| 4,749,731 | A | 6/1988 | Kyminas et al. | |
| 4,859,723 | A | 8/1989 | Kyminas et al. | |
| 5,434,009 | A | 7/1995 | Urbanek | |
| 5,711,116 | A * | 1/1998 | Hasan | 52/58 |
| 5,884,446 | A | 3/1999 | Hageman | |
| 6,055,786 | A * | 5/2000 | Hubbard et al. | 52/409 |
| 6,108,993 | A | 8/2000 | Hageman | |
| 6,245,850 | B1 | 6/2001 | Fields | |
| 6,502,360 | B2 | 1/2003 | Carr, III | |
| 6,544,596 | B2 | 4/2003 | Clemens | |
| 6,939,036 | B2 * | 9/2005 | Beck et al. | 374/55 |
| 7,070,844 | B2 * | 7/2006 | Bartek | 428/40.1 |
| 2002/0167989 | A1 * | 11/2002 | Russo | 374/141 |

* cited by examiner

*Primary Examiner*—Gail Verbitsky
(74) *Attorney, Agent, or Firm*—Robert D. Touslee

(57) ABSTRACT

A roofing membrane temperature indicator is provided for preventing the installation of a roofing membrane or roofing membranes at a temperature below a minimum recommended installation temperature for the roofing membrane(s) and/or a minimum recommended installation temperature for the roofing membrane(s) for a particular installation procedure. The membrane temperature indicator is visibly associated with the roofing membrane(s) and includes a thermochromic indicator having a first color at temperatures below a designated temperature and a second color visibly different from the first color at and above the designated temperature. The designated temperature at which the color of the membrane indicator changes is at or above a minimum recommended installation temperature for the roofing membrane(s) and/or a minimum recommended installation temperature for the roofing membrane(s) for a particular installation procedure.

10 Claims, 7 Drawing Sheets

ROOFING MEMBRANE TEMPERATURE INDICATOR

BACKGROUND OF THE INVENTION

The subject invention relates to roofing membranes and in particular to a roofing membrane temperature indicator that enables a roofing contractor to readily determine whether the temperature of a roofing membrane or a plurality of roofing membranes in a package is suitable for the installation of the roofing membrane(s) in a roofing system and thereby prevent an inadvertent installation of the roofing membrane(s) in a roofing system at a temperature below a minimum recommended installation temperature for the roofing membrane(s) and/or a minimum recommended installation temperature for the membrane(s) for a particular roofing membrane installation procedure.

Asphaltic roofing membranes with smooth or granular top surfaces, other roofing membranes (such as but not limited single ply PVC, TPO, and EPDM membranes sold by Johns Manville International, Inc. and other roofing product manufactures), and asphaltic, single ply, or other roofing membranes that have smooth or granular thermochromic top surfaces that undergo a visible color change at a specific temperature to promote energy conservation within a building should only be installed under conditions that conform to the application specifications set forth by the manufacturer. These application specifications permit the application of these roofing membranes only when the roofing membranes are at temperatures that are at or above minimum recommended installation temperatures. By requiring these roofing membranes to be at or above minimum recommended installation temperatures, the roofing membranes are not damaged during application due to a lack of sufficient pliability and good strong bonds are formed between the individual roofing membranes of a roofing layer and the roofing membranes of that layer and an underlying roofing layer. In general, application specifications require the roofing membranes set forth in this paragraph to be installed in a roofing system only when the roofing membranes are at temperatures of 40° F. (4° C.) or higher. Where these roofing membranes are self-adhering roofing membranes, the adhesion of these roofing membranes to other roofing membranes and roofing layers is highly dependent on the temperatures of the roofing membranes at the time of installation. Thus, these self-adhering roofing membranes should only be installed when the temperatures of these roofing membranes are sufficiently high to assure a good strong bond between these roofing membranes and between these roofing membranes and other roofing layers e.g. at temperatures of 50° F. (10° C.) or higher.

When a roofing system is being installed, the ambient temperature and the temperature of the roofing membranes to be installed in the roofing system may not and frequently do not coincide. Thus, ambient temperature alone cannot be relied upon to determine whether conditions are acceptable for the installation of the roofing membranes. For example, while the ambient temperature at the job site might be 40° F. or higher, the temperature of the roofing membranes to be installed, e.g. after being stored at the job site over night, might not be at or above the temperature required to meet application specifications, but at a temperature below that required to meet application specifications, e.g. at a temperature below 40° F. By way of another example, self-adhering roofing membranes should be at or above a specified temperature to meet application specifications, e.g. at or above 50° F. (10° C.), but can be installed when ambient temperatures are less than that temperature, e.g. at temperatures of 45° F. (7° C.) and rising during installation. Thus, a contractor cannot rely solely on knowing the ambient temperature when determining if application specifications for a roofing membrane are being met during the installation of the roofing membrane. The contractor must know both the ambient temperature and whether or not the roofing membranes to be installed are at or above a minimum recommended installation temperature for the roofing membranes.

SUMMARY OF THE INVENTION

The roofing membrane temperature indicator of the subject invention enables roofing contractors to readily determine if the temperature of a membrane, such as but not limited to a self-adhering membrane, is suitable for the installation of the roofing membrane in a roofing system and thereby prevents the installation of the roofing membrane at a temperature below a minimum recommended installation temperature for the roofing membrane. It is also contemplated that the roofing membrane temperature indicator of the subject invention can be used with a roofing membrane to enable roofing contractors to readily determine if the temperature of the membrane is suitable for a particular installation procedure and thereby prevents the installation of the roofing membrane at a temperature below a minimum recommended installation temperature for the roofing membrane for a particular installation procedure.

The membrane temperature indicator of the subject invention is visibly associated with the roofing membrane(s) and includes a thermochromic indicator (thermo-chromatic indicator) that changes color with temperature. The membrane temperature indicator of the subject invention has a first color below a designated temperature and a second color visibly different from and normally lighter than the first color at and above the designated temperature. Thus, the membrane temperature indicator of the subject invention lightens from a darker color (e.g. black or dark gray) to a lighter color (e.g. white or light gray) when the temperature of the roofing membrane(s) and membrane temperature indicator rises to and above the designated temperature and darkens from the lighter color (e.g. white or light gray) to the darker color (e.g. black or dark gray) when the temperature of the membrane(s) and membrane temperature indicator drops below the designated temperature. The designated temperature at which the color of the membrane temperature indicator changes is at or above a minimum recommended installation temperature for the roofing membrane and/or the minimum recommended installation temperature for the roofing membrane for a particular installation procedure. Thus, when the membrane temperature indicator changes from the first, e.g. darker color, to the second, e.g. lighter color, the membrane(s) with which the membrane temperature indicator is associated are at a temperature that is at or above the minimum recommended installation temperature for the membrane(s).

The membrane temperature indicator of the subject invention can be visibly associated with a package of roofing membranes or with individual roofing membranes. With a package of roofing membranes the membrane temperature indicator may overlie the roofing membranes or one or more of the roofing membranes may include a temperature indicator that is integral with, overlies, or is secured to the roofing membrane. With an individually packaged roofing membrane the temperature indicator of the subject invention can also be integral with, overlie, or be secured to the individual roofing membrane.

DESCRIPTION OF THE PREFERRED EMBODIMENTS

Figure 1:
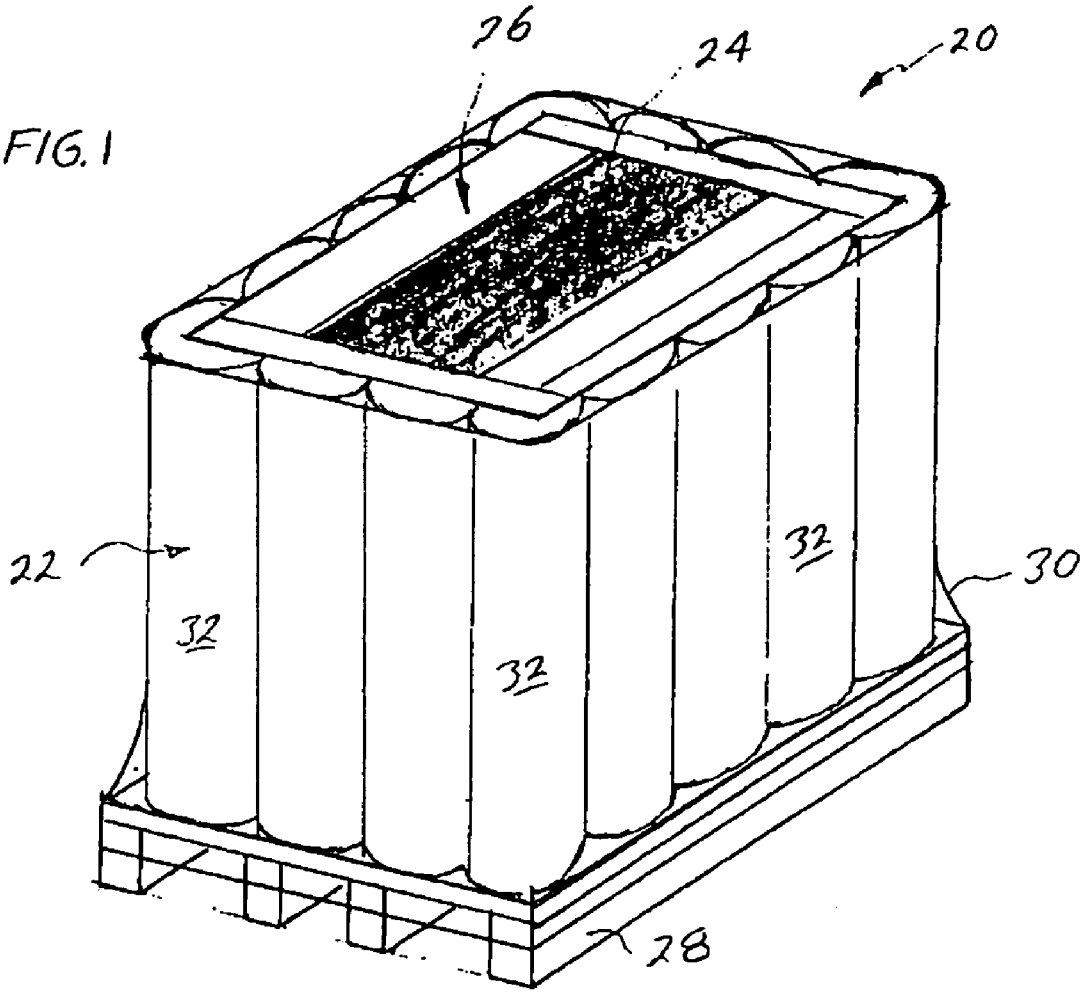
FIG. 1 is a schematic perspective view of a package of roofing membranes provided with a membrane temperature indicator of the subject invention wherein the temperature of the roofing membranes and membrane temperature indicator is below the designated temperature of the membrane temperature indicator.

The membrane temperature indicator of the subject invention is visibly associated with the roofing membrane(s) and includes a thermochromic indicator (thermo-chromatic indicator) that changes color with temperature. The membrane temperature indicator of the subject invention has a first color below a designated temperature and a second color visibly different from and normally lighter than the first color at and above the designated temperature. Thus, the membrane temperature indicator of the subject invention lightens from a darker color (e.g. black or dark gray) to a lighter color (e.g. white or light gray) when the temperature of the membrane(s) and membrane temperature indicator rises to and above the designated temperature and darkens from the lighter color (e.g. white or light gray) to the darker color (e.g. black or dark gray) when the temperature of the membrane(s) and membrane temperature indicator drops below the designated temperature. The designated temperature at which the color of the membrane temperature indicator changes is at or above a minimum recommended installation temperature for the roofing membrane and/or a minimum recommended installation temperature for the roofing membrane for a particular installation procedure.

The membrane temperature indicator of the subject invention can be visibly associated with a package of roofing membranes or with individual roofing membranes. The membrane temperature indicator of the subject invention can perform at least two functions by being in the form of a company logo, trademark, or some other desired indicia that, in addition to performing as a membrane temperature indicator, would typically promote a company that manufactures, sells or is otherwise involved with the manufacture, marketing, and/or installation of the membrane(s) with which the membrane temperature indicator is associated. Where the membrane temperature indicator of the subject invention is intended to function only as a membrane temperature indicator, the membrane temperature indicator can simply be in the form of a dot, circle, square, rectangle, triangle, other geometric configuration, or other indicia of a sufficient size and in a location that enables the membrane temperature indicator to be easily seen by the installers.

The membrane temperature indicator of the subject invention can be used with standard or self-adhering asphaltic roofing membranes that have smooth or granular top surfaces, with other standard or self-adhering roofing membranes (such as but not limited single ply PVC, TPO, and EPDM membranes sold by Johns Manville International, Inc.), and with standard or self-adhering asphaltic, single ply, or other roofing membranes that have smooth or granular thermochromic top or exposed surfaces that undergo a visible color change at a temperature of about 70° F.±5° F. to promote energy conservation within a building.

The designated temperature at which the membrane temperature indicator of the subject invention visibly changes color is selected to be at or above a minimum recommended installation temperature for the roofing membrane and/or at or above a minimum recommended installation temperature for the roofing membrane for a particular roofing membrane installation procedure. The minimum recommended roofing membrane installation temperature for the standard roofing membranes with which the membrane temperature indicator of the subject invention has been utilized is 40° F. (4° C.) and the minimum recommended roofing membrane installation temperature for the self-adhering roofing membranes with which the membrane temperature indicator of the subject invention has been utilized is 50° F. (10° C.). Thus, the selected designated temperature at which the color of the membrane temperature indicator of the subject invention changes for these roofing membranes is at least 40° F. (4° C.) for the standard membranes and at least 50° F. (10° C.) for the self-adhering membranes. Thus, by using the roofing membrane temperature indicator of the subject invention, a roofing contractor can readily determine whether the temperature of a roofing membrane is suitable for the installation of the roofing membrane and thereby prevent an inadvertent installation of the roofing membrane at a temperature below a minimum recommended installation temperature for the roofing membrane and/or a minimum recommended installation temperature for the roofing membrane for a particular roofing membrane installation procedure.

The membrane temperature indicator of the subject invention can be selectively made to visibly change color at a designated temperature: to indicate whether a roofing membrane is either below or at or above a minimum recommended installation temperature for the roofing membrane; to indicate that whether a roofing membrane is either below or at or above a minimum recommended installation temperature for a particular roofing membrane installation procedure; or to indicate whether a roofing membrane is either below or at or above a minimum recommended installation temperature for a roofing membrane and a minimum recommended installation temperature for a particular roofing membrane installation procedure.

Figure 2:
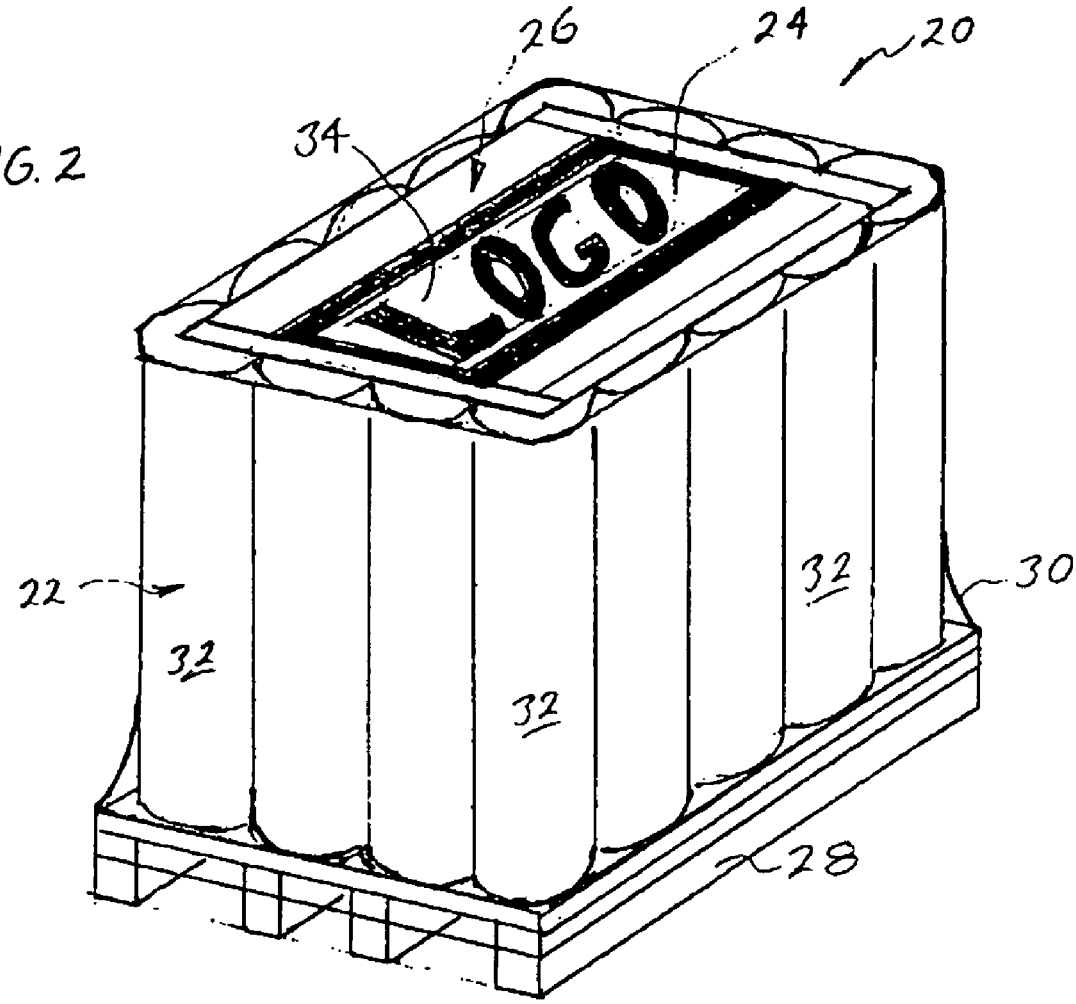
FIG. 2 is a schematic perspective view of the package of roofing membranes shown in FIG. 1 wherein the temperature of the roofing membranes and membrane temperature indicator is at or above the designated temperature of the membrane temperature indicator.

With a package of roofing membranes, the package may include one or more membrane temperature indicators that overlie the roofing membranes and are visible from outside the package or one or more of the roofing membranes within the package may include membrane temperature indicator(s) that are integral with or secured to the roofing membrane(s) and visible from outside the package. As shown in FIGS. 1 and 2, a package 20 containing a plurality of roofing membrane rolls 22 also contains one or more membrane temperature indicators 24 of the subject invention that are integral with splicing membrane(s) 26, such as but not limited to end lap cap sheet splicing membranes of the type shown in FIGS. 12 and 13. The package 20 includes a pallet 28 and a transparent or translucent stretch wrap or shrink wrap film 30 that overlies and secures the roofing membrane rolls 22 to the pallet 28 and secures the one or more splicing membrane(s) 26 over the roofing membrane rolls 22 during the storage, shipment and handling of the rolls prior to installation so that at least one membrane temperature indicator 24 within the package 20 is clearly visible from outside the package.

Figure 3:
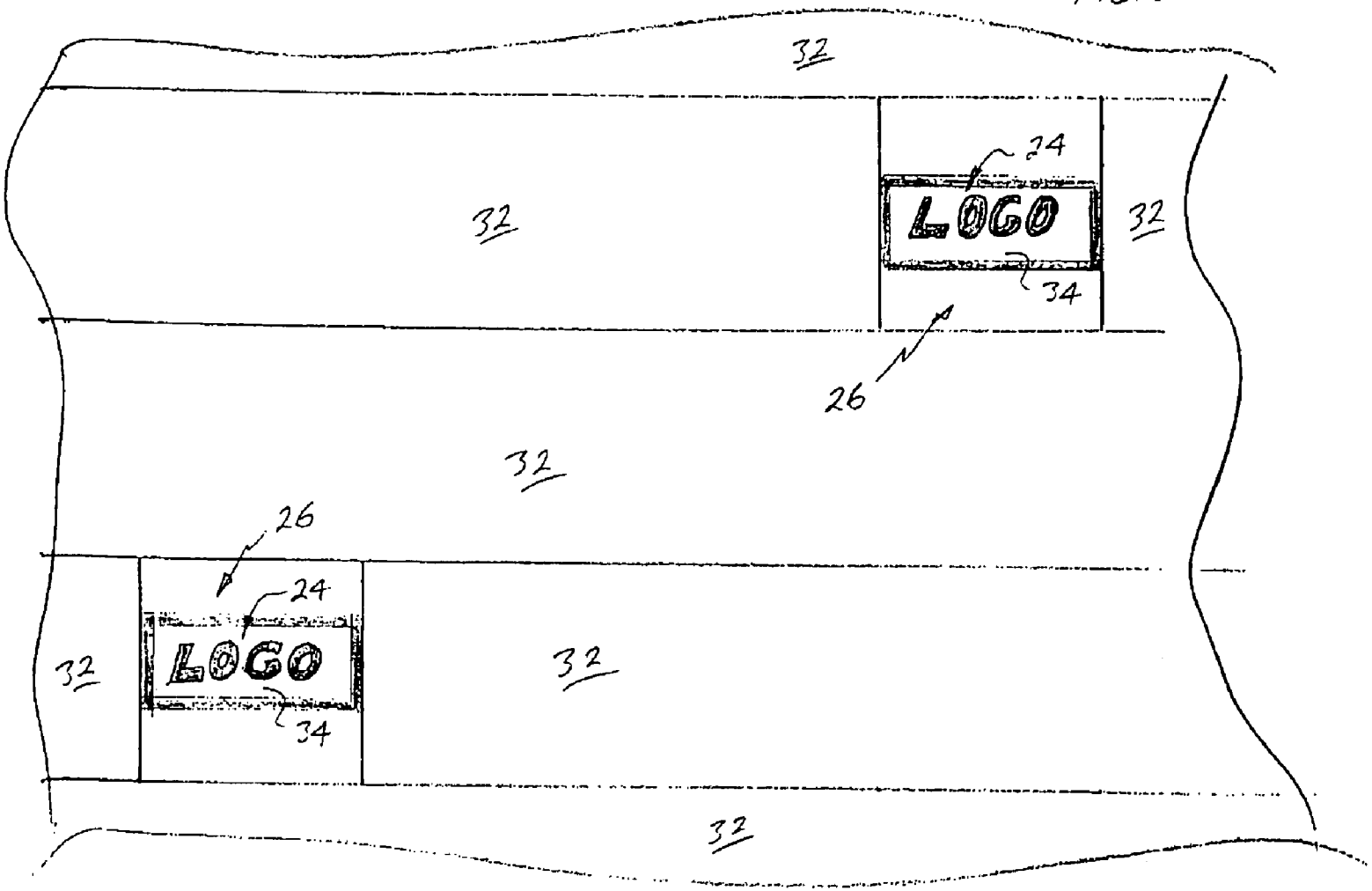
FIG. 3 is a schematic view from above of at least some of the roofing membranes from the package of FIGS. 1 and 2 and two membrane temperature indicators from the package of FIGS. 1 and 2 installed on a roof with the temperature of the roofing membranes and membrane temperature indicators at or above the designated temperature of the membrane temperature indicator.

In FIG. 1, the roofing membranes 32 of the roofing membrane rolls 22 and the membrane temperature indicator 24 are below the designated temperature of the membrane temperature indicator 24 and the membrane temperature indicator 24 visibly indicates that the membrane temperature indicator 24 and the roofing membranes 32 are at a temperature below a minimum recommended installation temperature for the roofing membranes 32 and/or a minimum recommended installation temperature for the roofing membranes 32 for a particular roofing membrane installation procedure. In FIG. 2, the roofing membranes 32 of the roofing membrane rolls 22 and the membrane temperature indicator 24 are at or above the designated temperature of the membrane temperature indicator 24 and thermochromic portions 34 of the membrane temperature indicator 24 have lightened to visibly indicate that the membrane temperature indicator 24 and the roofing membranes 32 of the roofing membrane rolls 22 are at a temperature at or above a minimum recommended installation temperature for the roofing membranes 32 and/or a minimum recommended installation temperature for the roofing membranes 32 for a particular roofing membrane installation procedure. FIG. 3 shows at least some of the roofing membranes 32 from the package 20 of FIGS. 1 and 2 and two splicing membranes 26 with membrane temperature indicators 24 from the package 20 of FIGS. 1 and 2 installed on a roof with the temperature of the roofing membranes 32 and membrane temperature indicators 24 at or above the designated temperature of the membrane temperature indicator.

Figure 4:
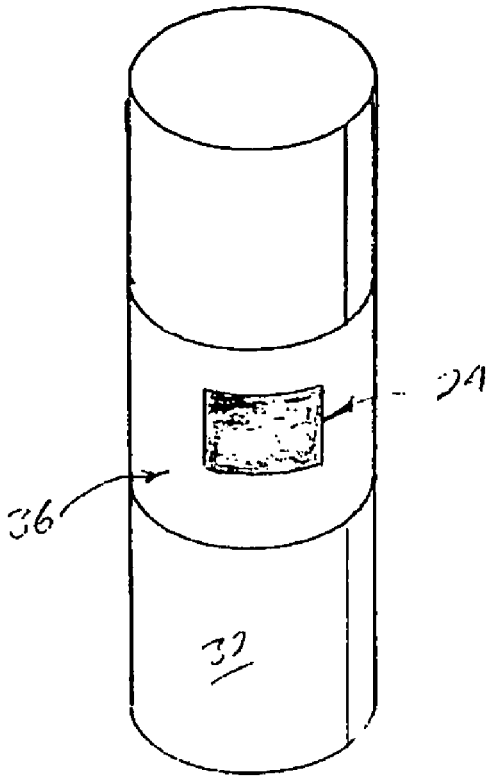
FIG. 4 is a schematic perspective view of a roofing membrane roll with a membrane temperature indicator on the packaging sleeve and the temperature of the roofing membrane and membrane temperature indicator below the designated temperature of the membrane temperature indicator.
Figure 5:
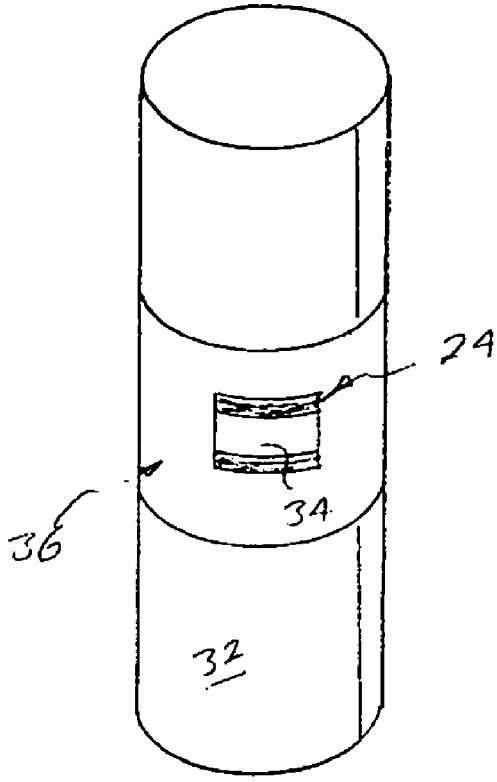
FIG. 5 is a schematic perspective view of a roofing membrane roll with a membrane temperature indicator on the packaging sleeve and the temperature of the roofing membrane and membrane temperature indicator at or above the designated temperature of the membrane temperature indicator.

With an individual roofing membrane 32 the membrane temperature indicator 24 of the subject invention can be integral with, overlie, or be secured to the individual roofing membrane. While there are many different ways the membrane temperature indicator 24 can overlie or be secured to an individual roofing membrane 32, FIGS. 4 and 5 show a roofing membrane roll 22 wherein the membrane temperature indicator 24 is located on a packaging sleeve 36 that encircles the roofing membrane roll. In FIG. 4, the roofing membrane 32 of the roofing membrane roll 22 and the membrane temperature indicator 24 are below the designated temperature of the membrane temperature indicator 24 and the membrane temperature indicator 24 visibly indicates that the membrane temperature indicator 24 and the roofing membrane 32 are at a temperature below a minimum recommended installation temperature for the roofing membrane 32 and/or a minimum recommended installation temperature for the roofing membranes 32 for a particular roofing membrane installation procedure. In FIG. 5, the roofing membrane 32 of the roofing membrane roll 22 and the membrane temperature indicator 24 are at or above the designated temperature of the membrane temperature indicator 24 and thermochromic portions 34 of the membrane temperature indicator 24 have lightened to visibly indicate that the membrane temperature indicator 24 and the roofing membrane 32 of the roofing membrane roll 22 are at a temperature at or above a minimum recommended installation temperature for the roofing membrane 32 and/or a minimum recommended installation temperature for the roofing membrane for a particular roofing membrane installation procedure.

Figure 6:
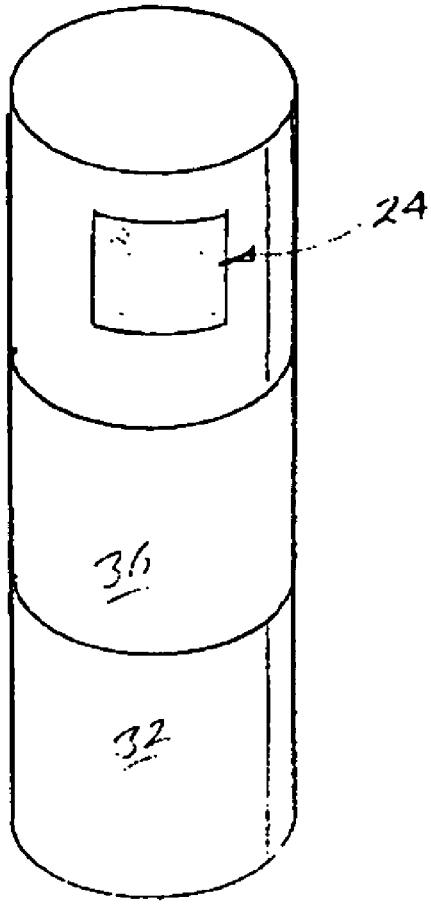
FIG. 6 is a schematic perspective view of a roofing membrane roll with a membrane temperature indicator secured to or integral with the roofing membrane and the temperature of the roofing membrane and membrane temperature indicator below the designated temperature of the membrane temperature indicator.
Figure 7:
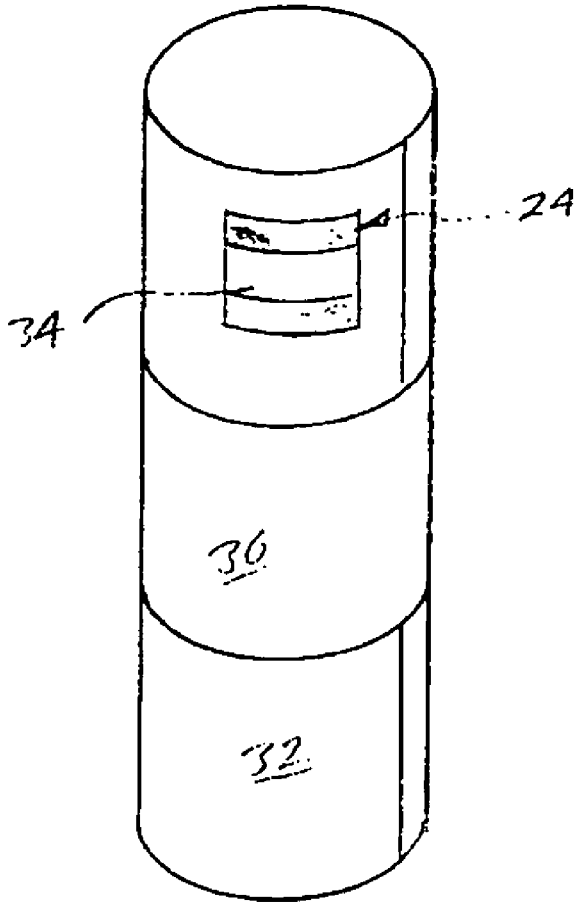
FIG. 7 is a schematic perspective view of a roofing membrane roll with a membrane temperature indicator secured to or integral with the roofing membrane and the temperature of the roofing membrane and membrane temperature indicator at or above the designated temperature of the membrane temperature indicator.

FIGS. 6 and 7 show a roofing membrane roll 22 held in roll form by a packaging sleeve 36 wherein the membrane temperature indicator 24 is an integral part of the roofing membrane 32 and located at or adjacent one end of the roofing membrane 32 so that the membrane temperature indicator 24 is visible when the membrane is wound into the roll 22. In FIG. 6, the roofing membrane 32 of the roofing membrane roll 22 and the membrane temperature indicator 24 are below the designated temperature of the membrane temperature indicator 24 and the membrane temperature indicator 24 visibly indicates that the membrane temperature indicator 24 and the roofing membrane 32 are at a temperature below a minimum recommended installation temperature for the roofing membrane 32 and/or a minimum recommended installation temperature for the roofing membrane 32 for a particular roofing membrane installation procedure. In FIG. 7, the roofing membrane 32 of the roofing membrane roll 22 and the membrane temperature indicator 24 are at or above the designated temperature of the membrane temperature indicator 24 and thermochromic portions 34 of the membrane temperature indicator 24 have lightened to visibly indicate that the membrane temperature indicator 24 and the roofing membrane 32 of the roofing membrane roll 22 are at a temperature at or above a minimum recommended installation temperature for the roofing membrane 32 and/or a minimum recommended installation temperature for the roofing membrane 32 for a particular roofing membrane installation procedure.

FIGS. 8 to 13 show examples of roofing membrane assemblies that have roofing membranes incorporating the membrane temperature indicator 24 of the subject invention. While the roofing membrane assemblies of FIGS. 8 to 13 include self-adhering roofing membranes, the membrane temperature indicator 24 can also be used with standard roofing membranes that are not self-adhering roofing membranes. The self-adhering roofing membranes of FIGS. 8 to 13 form watertight bonds with other roof components primarily with the application of pressure and without the need to use heat, flame, an additional adhesive material, or hot asphalt material. The thicknesses of the components of these roofing membrane assemblies are exaggerated to better show detail of the assemblies.

Figure 8:
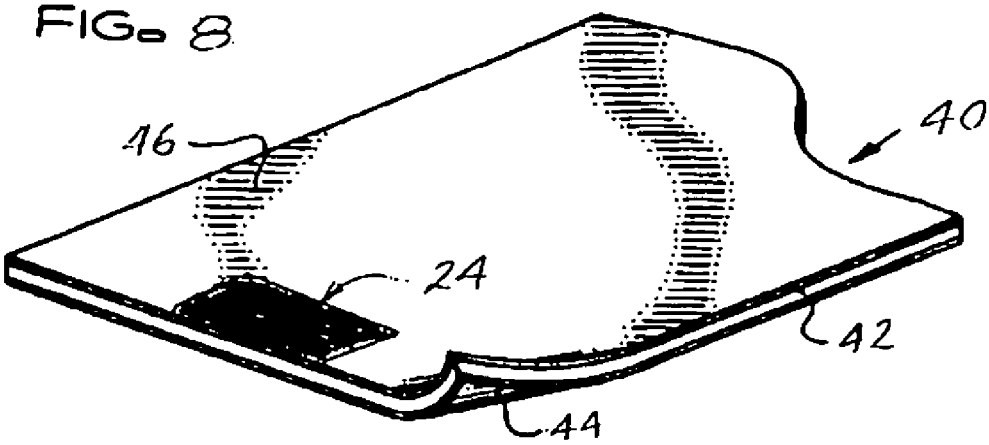
FIGS. 8 to 13 are schematic perspective views of examples of roofing membranes incorporating the membrane temperature indicator of the subject invention with the roofing membranes and membrane temperature indicators shown both below and at or above the designated temperature of the membrane temperature indicators.
Figure 9:
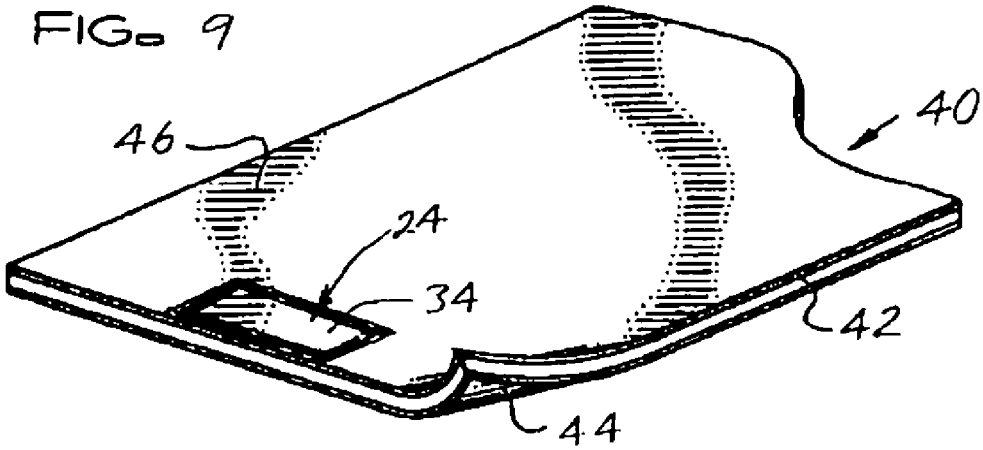

FIGS. 8 and 9 show an end portion of a base sheet assembly 40 wherein the membrane temperature indicator 24 is an integral part of the base sheet membrane 42 of the assembly and located at or adjacent one end of the base sheet membrane so that the membrane temperature indicator 24 is visible when the base sheet membrane, as part of the base sheet assembly 40, is wound in a roll for storage, shipping, and handling. In FIG. 8, the base sheet membrane 42 and the membrane temperature indicator 24 are below the designated temperature of the membrane temperature indicator 24 and the membrane temperature indicator 24 visibly indicates that the membrane temperature indicator 24 and the base sheet membrane 42 are at a temperature below a minimum recommended installation temperature for the base sheet membrane 42 and/or a minimum recommended installation temperature for the base sheet membrane 42 for a particular roofing membrane installation procedure. In FIG. 9, the base sheet membrane 42 and the membrane temperature indicator 24 are at or above the designated temperature of the membrane temperature indicator 24 and thermochromic portions 34 of the membrane temperature indicator 24 have lightened to visibly indicate that the membrane temperature indicator 24 and the base sheet membrane 42 are at a temperature at or above a minimum recommended installation temperature for the base sheet membrane 42 and/or a minimum recommended installation temperature for the base sheet membrane 42 for a particular roofing membrane installation procedure.

As shown in FIGS. 8 and 9, the base sheet assembly 40 of the subject invention has: a waterproof self-adhering base sheet 42, a bottom surface release sheet 44 that forms a bottom surface of the base sheet assembly, and a transparent or translucent top surface release sheet 46 that forms a top surface of the base sheet assembly and enables the membrane temperature indicator 24 to be easily viewed through the release sheet. With the release sheets 44 and 46 of the base sheet assembly removed, the waterproof base sheet 42 can be self-adhered to other waterproof self-adhering base sheets 42 to form a watertight roofing system layer and to an overlying roofing system layer and an underlying roofing system layer.

The waterproof self-adhering base sheet 42 of the base sheet assembly 40 may be of various lengths, widths, and thicknesses, but preferably is about 30 to about 60 feet long, about 39 inches wide (typically 39⅜ inches wide), and between about 0.04 and about 0.16 inches thick (about 10 to about 20 meters long, 880 to 1020 millimeters wide, and between about 1 and about 4 millimeters thick). The waterproof self-adhering base sheet 42 typically has a reinforcing layer, such as a non-woven polyester, fiberglass, or polyester/fiberglass reinforcement mat, encapsulated within a self-adhering bitumen material. This self-adhering bitumen material forms a bottom layer and a bottom major surface of the waterproof self-adhering base sheet 42 and a top layer and a top major surface of the waterproof self-adhering base sheet.

Figure 10:
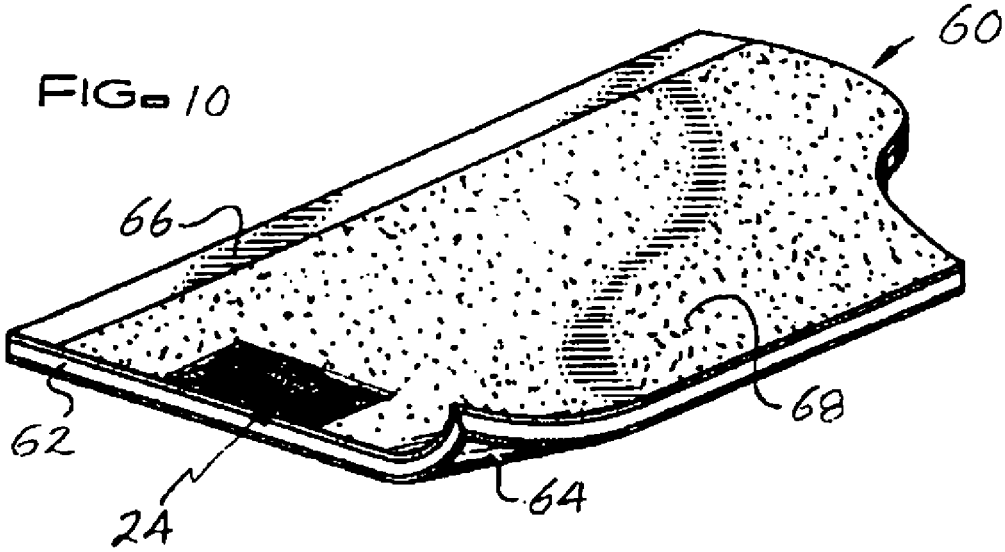
Figure 11:
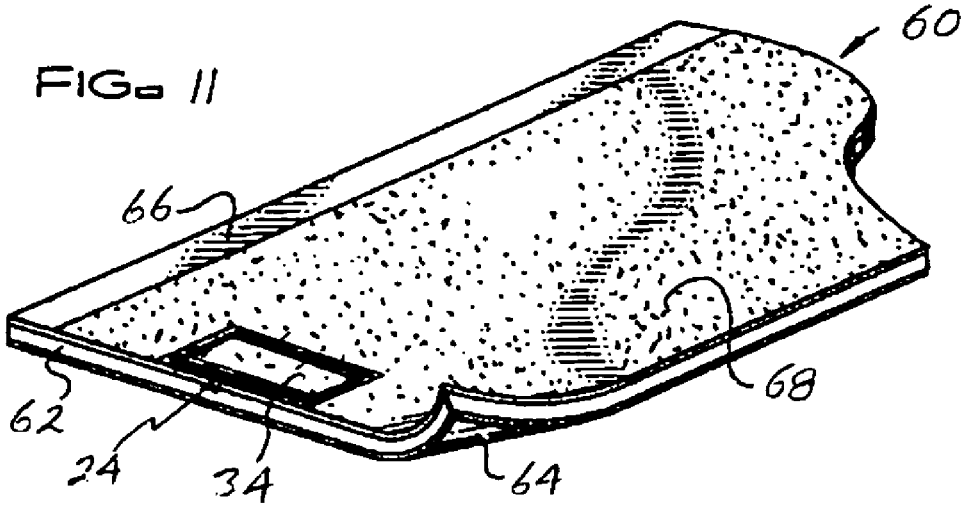

FIGS. 10 and 11 show an end portion of a cap sheet assembly 60 wherein the membrane temperature indicator 24 is an integral part of the cap sheet membrane 62 of the assembly and located at or adjacent one end of the cap sheet membrane so that the membrane temperature indicator 24 is visible when the cap sheet membrane, as part of the cap sheet assembly 60, is wound in a roll for storage, shipping and handling. In FIG. 10, the cap sheet membrane 62 and the membrane temperature indicator 24 are below the designated temperature of the membrane temperature indicator 24 and the membrane temperature indicator 24 visibly indicates that the membrane temperature indicator 24 and the cap sheet membrane 62 are at a temperature below a minimum recommended installation temperature for the cap sheet membrane 62 and/or a minimum recommended installation temperature for the cap sheet membrane 62 for a particular roofing membrane installation procedure. In FIG. 11, the cap sheet membrane 42 and the membrane temperature indicator 24 are at or above the designated temperature of the membrane temperature indicator 24 and thermochromic portions 34 of the membrane temperature indicator 24 have lightened to visibly indicate that the membrane temperature indicator 24 and the cap sheet membrane 62 are at a temperature at or above a minimum recommended installation temperature for the cap sheet membrane 62 and/or a minimum recommended installation temperature for the cap sheet membrane 62 for a particular roofing membrane installation procedure.

As shown in FIGS. 10 and 11, the cap sheet assembly 60 of the subject invention has: a waterproof cap sheet membrane 62, a bottom surface release sheet 64 that forms a bottom surface of the cap sheet assembly, and a top surface selvage edge portion release sheet 66 that forms one lateral edge portion of a top surface of the cap sheet assembly. With the bottom release sheet 64 of the cap sheet assembly removed, the waterproof cap sheet membrane 62 can be adhered to an underlying roofing system layer formed by a plurality of the waterproof base sheets, such as but not limited to the self-adhering base sheets 42, by pressing the cap sheet membrane 62 against the top surface of the underlying roof system layer. With the top surface selvage edge portion release sheet 66 removed, the selvage edge portion of the cap sheet membrane 62 may be bonded, primarily by the application of pressure to an overlapping lateral edge portion of another cap sheet to form a watertight topmost layer of a roof system.

The waterproof cap sheet membrane 62 of the cap sheet assembly 60 may be of various lengths, widths, and thicknesses, but preferably, is about 30 to about 45 feet long, about 39 inches wide (typically 39⅜ inches wide), and between about 0.08 and about 0.20 inches thick (about 10 to about 15 meters long, 880 to 1020 millimeters wide, and between about 2 and about 5 millimeters thick). The waterproof cap sheet membrane 62 includes a reinforcing layer, such as a non-woven polyester, fiberglass, or polyester/fiberglass reinforcement mat, encapsulated within modified self-adhering bitumen. The modified bitumen forms a bottom layer and a bottom major surface of the waterproof cap sheet membrane 62. The modified bitumen also forms a top layer and a selvage edge portion surface of the top major surface of the waterproof cap sheet membrane. The selvage edge portion surface of the top major surface of the waterproof cap sheet 62 is between about 3 inches and about 13 inches wide and preferably about 8 inches wide (between about 75 and about 320 millimeters wide and preferably about 200 millimeters wide) and extends along one lateral edge of the cap sheet membrane for the entire length of the cap sheet membrane. The remainder of the top major surface of the waterproof cap sheet membrane 62 is surfaced with a conventional surfacing material such as but not limited to roofing granules 68, sand, or other coating materials.

Figure 12:
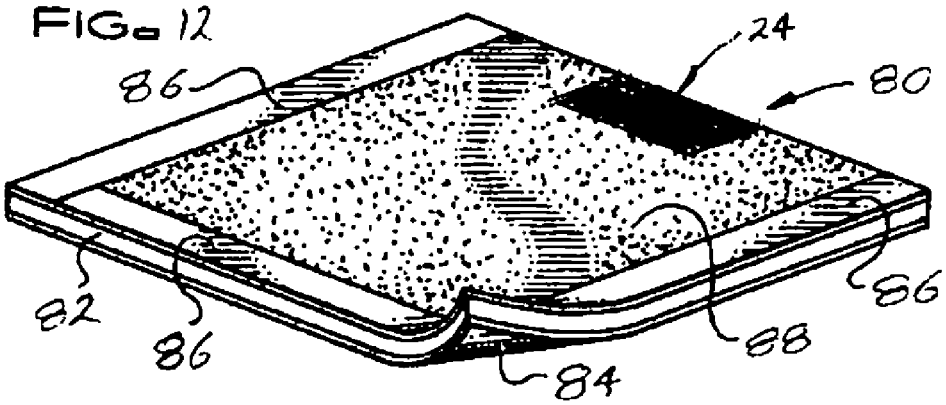
Figure 13:
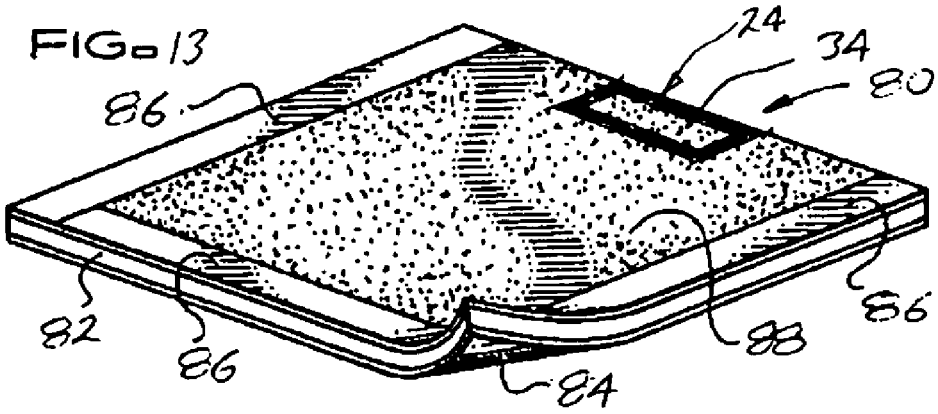

FIGS. 12 and 13 show an end lap cap sheet splicing assembly 80 wherein the membrane temperature indicator 24 is an integral part of the end lap cap sheet splicing membrane 82 of the assembly. In FIG. 12, the end lap cap sheet splicing membrane 82 and the membrane temperature indicator 24 are below the designated temperature of the membrane temperature indicator 24 and the membrane temperature indicator 24 visibly indicates that the membrane temperature indicator 24 and the end lap cap sheet splicing membrane 82 are at a temperature below a minimum recommended installation temperature for the end lap cap sheet-splicing membrane 82 and/or a minimum recommended installation temperature for the end lap cap sheet splicing membrane 82 for a particular roofing membrane installation procedure. In FIG. 13, the end lap cap sheet splicing membrane 82 and the membrane temperature indicator 24 are at or above the designated temperature of the membrane temperature indicator 24 and thermochromic portions 34 of the membrane temperature indicator 24 have lightened to visibly indicate that the membrane temperature indicator 24 and the end lap cap sheet splicing membrane 82 are at a temperature at or above a minimum recommended installation temperature for the end lap cap sheet splicing membrane 82 and/or a minimum recommended installation temperature for the end lap cap sheet splicing membrane 82 for a particular roofing membrane installation procedure.

As shown in FIGS. 12 and 13, the end lap cap sheet splicing assembly 80 includes: a waterproof self-adhering end lap cap sheet splicing membrane 82, a bottom surface release sheet 84 that forms a bottom surface of the end lap cap sheet splicing assembly, and three top surface edge portion release sheets 86 that form three of the edge portions of a top surface of the end lap cap sheet splicing assembly. With the bottom release sheet 84 of the end lap cap sheet splicing assembly removed, the self-adhering bottom major surface of the waterproof self-adhering end lap cap sheet splicing membrane 82 can be adhered to an underlying roofing system layer by pressing the waterproof self-adhering end lap cap sheet splicing membrane 82 against the top surface of the underlying roofing system layer. With the opposing top surface lateral edge portion release sheets 86 removed, the opposing top self-adhering surfaces of the lateral edge portions of the waterproof self-adhering end lap cap sheet splicing membrane 82 may be bonded by the application of pressure to overlapping end lap edge portions of successive lengths of cap sheet, such as but not limited to cap sheet 60, to form a continuous length of cap sheet from two separate lengths of cap sheet at the job site. When the self-adhering end lap cap sheet splicing membrane 82 is installed, the top self-adhering surface of third self-adhering edge portion of the waterproof self-adhering end lap cap sheet splicing membrane 82 forms, along with the top surfaces of selvage edge portions of the cap sheets spliced together by the splicing membrane 82, a continuous self-adhering selvage edge portion surface for the joined cap sheets.

The waterproof self-adhering end lap cap sheet splicing membrane 82 may be of various lengths, widths, and thicknesses, but preferably, the self-adhering end lap cap sheet splicing membrane 82 is a square in shape with each side of the square having the same dimension as the width of the cap sheets being joined by the splicing membrane. The waterproof self-adhering end lap cap sheet splicing membrane 82 has a reinforcing layer, such as a non-woven polyester, fiberglass, or polyester/fiberglass reinforcement mat, encapsulated within modified bitumen. The modified bitumen forms a bottom layer and the self-adhering bottom major surface of the waterproof self-adhering end lap cap sheet splicing membrane 82. The modified bitumen also forms an upper layer and the self-adhering top surfaces of the three self-adhering edge portions of the top major surface of the waterproof self-adhering end lap cap sheet splicing membrane 82. The remainder of the top major surface of the waterproof end lap cap sheet splicing membrane 82 is surfaced with a conventional surfacing material such as but not limited to roofing granules 88, sand, or other coating materials.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A package of roofing membrane rolls, comprising:

a plurality of roofing membrane rolls;

packaging means holding the plurality of roofing membrane rolls together for storage, shipping, and handling prior to installation of roofing membranes forming the roofing insulation rolls; the packaging means comprising a pallet and a transparent or translucent film wrap that overlies and secures the roofing membrane rolls together and to the pallet; and a membrane temperature indicator for preventing the installation of the roofing membranes at a temperature below a minimum recommended installation temperature for the roofing membranes and/or a minimum recommended installation temperature for the roofing membranes for a particular installation procedure; the membrane temperature indicator being visible through the film wrap of the packaging means and comprising a thermochromic indicator having a first color at temperatures below a designated temperature and a second color visibly different from the first color at and above the designated temperature; and the designated temperature being at or above the minimum recommended installation temperature for the roofing membranes and/or the minimum recommended installation temperature for the particular installation procedure.

2. The package of roofing membranes according to claim 1, wherein:

the roofing membranes are asphalt-based roofing membranes.

3. The package of roofing membranes according to claim 1, wherein:

the roofing membranes are single-ply roofing membranes.

4. The package of roofing membranes according to claim 1, wherein:

the roofing membranes are thermochromic roofing membranes that have top surfaces that undergo a visible color change at a temperature of about 70°F. ±5°F.

5. The package of roofing membranes according to claim 1, wherein:

the membrane temperature indicator is an integral part of at least one of the roofing membranes.

6. The package of roofing membranes according to claim 1, wherein:

at least some of the roofing membranes are base sheet membranes.

7. The package of roofing membranes according to claim 1, wherein:

at least some of the roofing membranes are cap sheet membranes.

8. The package of roofing membranes according to claim 1, wherein:

at least some of the roofing membranes are end lap cap sheet splicing membranes.

9. The package of roofing membranes according to claim 1, wherein:

the film wrap is a stretch wrap film.

10. The package of roofing membranes according to claim 1, wherein:

the film wrap is a shrink wrap film.

* * * * *